US005463453A

United States Patent [19]

Kurotori et al.

[11] Patent Number: 5,463,453

[45] Date of Patent: Oct. 31, 1995

[54] WET-TYPE IMAGE FORMATION APPARATUS

[75] Inventors: Tsuneo Kurotori, Tokyo; Manabu Mochizuki; Kenzo Ariyama, both of Yokohama; Kenji Kojima; Ichiro Tsuruoka, both of Tokyo; Katsuhiro Echigo, Yokohama; Mayumi Miyao, Tokyo; Itsuo Ikeda, Sagamihara, all of Japan

[73] Assignee: Ricoh Company, Ltd., Tokyo, Japan

[21] Appl. No.: 6,179

[22] Filed: Jan. 15, 1993

Related U.S. Application Data

[62] Division of Ser. No. 569,931, Aug. 20, 1990, abandoned.

[30] Foreign Application Priority Data

| | | | |
|---|---|---|---|
| Aug. 9, 1989 | [JP] | Japan | 1-204579 |
| Aug. 9, 1989 | [JP] | Japan | 1-204581 |
| Aug. 26, 1989 | [JP] | Japan | 1-218891 |
| Oct. 4, 1989 | [JP] | Japan | 1-259078 |
| Oct. 4, 1989 | [JP] | Japan | 1-259079 |
| Oct. 4, 1989 | [JP] | Japan | 1-259080 |
| Oct. 4, 1989 | [JP] | Japan | 1-259081 |

[51] Int. Cl.[6] ..... G03G 15/10; G03G 15/11

[52] U.S. Cl. ..... 355/256; 430/114; 430/117

[58] Field of Search ..... 355/256, 298, 355/259; 430/117, 119, 114

[56] References Cited

U.S. PATENT DOCUMENTS

| | | | |
|---|---|---|---|
| 3,856,692 | 12/1974 | Mammino et al. | 430/116 |
| 3,909,433 | 9/1975 | Gilliams et al. | 430/116 |
| 4,062,789 | 12/1977 | Tamai et al. | 430/116 |
| 4,227,797 | 10/1980 | Tsunoi | 118/659 X |
| 4,351,604 | 9/1982 | Karasawa et al. | 118/653 X |
| 4,437,755 | 3/1984 | Sakurayama et al. | 118/652 X |
| 4,842,972 | 6/1989 | Tavernier et al. | 430/117 |
| 4,860,050 | 8/1989 | Kurotori et al. | 355/256 |
| 4,960,666 | 10/1990 | Weagley et al. | 430/114 |

*Primary Examiner*—R. L. Moses
*Attorney, Agent, or Firm*—Cooper & Dunham

[57] ABSTRACT

A wet-type image formation apparatus comprising a latent electrostatic image formation unit capable of forming on a latent-electrostatic-image-bearable photoconductive member a latent electrostatic image corresponding to an original image; and a wet-type development unit capable of developing the latent electrostatic image into a visible toner image with a liquid developer composed of (i) a carrier liquid comprising a petroleum aliphatic hydrocarbon and a silicone oil with a siloxane structure, and (ii) toner particles comprising a coloring agent and a binder resin, which are dispersed in the above-mentioned carrier liquid.

22 Claims, 8 Drawing Sheets

MIXING RATIO (%)

| | KF-58 | ISOPAR H |
|---|---|---|
| $X_1$ | 100 | 0 |
| $X_2$ | 90 | 10 |
| $X_3$ | 75 | 25 |
| $X_4$ | 50 | 50 |
| $X_5$ | 25 | 75 |

WET-TYPE IMAGE FORMATION APPARATUS

This is a division of application Ser. No. 569,931, filed Aug. 20, 1990, now abandoned.

BACKGROUND OF THE INVENTION

1. Field of the Invention

The present invention relates to an image formation apparatus employing the electrostatic recording method, such as a plain paper copier (PPC) and an electrostatic printer, and in particular to a wet-type image formation apparatus in which a latent electrostatic image is developed with a liquid-type developer.

2. Discussion of Background

Liquid developers for use in a wet-type image formation apparatus are conventionally disclosed in Japanese Laid-Open Patent Applications 52-17419, 61-180248 and 63-4249.

In general, a liquid developer prepared by dispersing toner particles comprising a coloring agent and a binder resin in a petroleum aliphatic hydrocarbon solvent serving as a carrier liquid is conventionally used in a wet-type plain paper copier (PPC) to obtain satisfactory image-fixing performance. Commercially available petroleum aliphatic hydrocarbon solvents, such as "Isopar C", "Isopar E", "Isopar G", "Isopar H", "Isopar K", "Isopar L", "Isopar M" and "Solvesso 150" (Trademark), made by Exxon Chemical Japan Ltd.; and "Shellsol 71" (Trademark), made by Shell Kagaku K.K., are well known. In addition to the above, cyclohexane, n-hexane, n-heptane, n-octane, isooctane, isododecane and ligroin are used as the carrier liquids for the liquid developer.

The carrier liquids for the liquid developer are required to have the following properties: (1) a high electrical resistivity of $10^{14}$ Ωcm or more; (2) a low dielectric constant of 3 or less; (3) a low solubility; (4) no odor; (5) transparent; (6) not irritating to the skin; (7) nontoxic; (8) low flammability of 50° C. or more; (9) thermally stable; and (10) quick-drying.

Table 1 shows the boiling point and the average molecular weight of the above-mentioned petroleum aliphatic hydrocarbon solvents, commercially available under the name of "Isopar" from Exxon Chemical Japan Ltd.

TABLE 1

| | Boiling Point(° C.) | Average Molecular Weight |
|---|---|---|
| Isopar C | 97.8 to 102.8 | — |
| Isopar E | 115.6 to 141.1 | 120 |
| Isopar G | 159.0 to 176.7 | 149 |
| Isopar H | 176.7 to 183.3 | 154 |
| Isopar K | 176.7 to 195.0 | 156 |
| Isopar L | 188.9 to 207.8 | 165 |
| Isopar M | 206.1 to 246.7 | 177 |

The liquid developer can be prepared by kneading a coloring agent, a binder resin and a small amount of additives together with the above-mentioned carrier liquid in a ball mill or Keddy mill to obtain a concentrated toner, and dispersing the concentrated toner in an appropriate amount of the carrier liquid.

Recently, as the plain paper copier (PPC) becomes prevailing in the field of wet-type copying operation, a demand for excellent copy images with high image density is increasing. To satisfy this demand, a large quantity of toner is caused to be deposited on a transfer sheet. However, in the case where the petroleum aliphatic hydrocarbons are used as the carrier liquid for the liquid developer in the plain paper copier, the vapor of the petroleum aliphatic hydrocarbons eventually builds up in the room where the copier is in operation when the amount of toner to be deposited on the transfer sheet is increased. As the concentration of the vapor is increased, the vaporized carrier liquid gives out an offensive or unpleasant odor in the image-fixing performance. In the case where the copier is operated in a room without ventilation, it is necessary to restrict the copying speed, with the offensive odor caused by the vaporized petroleum aliphatic hydrocarbon taken into consideration. When the petroleum aliphatic hydrocarbon is applied to the high-speed copying apparatus employing the wet-type development system, the offensive odor is unfavorably generated in the image-fixing operation. For this reason, the petroleum aliphatic hydrocarbons are not adequate for the high-speed copying operation.

The wet-type plain paper copier is constructed in such a fashion that the liquid developer circulates therein by means of a pump. More specifically, the developer which has not been used for developing a latent electrostatic image is recovered in a cleaning unit by the aid of a cleaning foam roller, and returned to a liquid developer reservoir through a cleaning developer recovery hole. The toner particles in the liquid developer are repeatedly used in the above-mentioned manner, so that toner particles are not wasted, and a large number of copies can be made by a relatively small amount of the liquid developer.

The conventional wet-type plain paper copier has the shortcoming that the image quality is degraded when the copying operation is performed for an extended period of time or the copying operation is resumed after a long non-use period. For instance, abnormal images such as white narrow stripes appear in solid image areas as shown in FIG. 7. This is ascribed to the inadequate circulation of the liquid developer in the copier. The toner particles remaining on the photoconductor after image transfer are collected in the cleaning unit, and the toner particles deposited to the development rollers are scraped off the rollers by scrapers and collected in the development unit, so that most of the toner particles are returned to a liquid developer reservoir by the circulating mechanism and uniformly dispersed again in the carrier liquid to form a liquid-type developer with a predetermined concentration. When the petroleum aliphatic hydrocarbon is used alone as the carrier liquid for the liquid developer, part of the toner particles are left alone in the cleaning unit and the development unit because the above-mentioned petroleum aliphatic hydrocarbon easily evaporates. As the petroleum aliphatic hydrocarbon continues to evaporate for an extended period of time, only the toner particles accumulate just like sludge. These sludgy toner particles are usually washed away by the flow of a circulating liquid developer for cleaning, thereby returning to the liquid developer reservoir. However, the sludgy toner particles are deposited over an extended period of time in a dead space where the flow of the circulating liquid developer for cleaning is weak. In the case where the copying operation ceases for a long time, the water component of the sludgy toner particles gradually evaporates, and finally toner particles are agglomerated in the form of a flake, so that they cannot easily be dispersed again in the carrier liquid. The diameter of the toner particle thus formed in a flake is as large as 1 to 500 μm, when compared with a normal toner particle having a diameter of 0.5 to 0.8 μm, so that these toner particles in the form of a flake, which do not contribute to the development operation, are caught in the gap between development rollers and the photoconductor, which is designed to have a distance of 100 to 150 μm. This causes abnormal images, such as white narrow stripes on a solid formed on the transfer sheet.

In the wet-type image formation apparatus, not only copied images with high image density, but also high-speed copying operation free from the problem of the offensive odor is highly desired. Thus, a silicone oil with a siloxane structure is proposed as the carrier liquid for the liquid developer because it does not generate the unpleasant odor while in use for image fixing.

The above-mentioned silicone oils with a siloxane structure, represented by methylphenyl polysiloxane, have a relatively high viscosity, so that they do not easily evaporate. Therefore, when the silicone oil with a siloxane structure is used as the carrier liquid for the liquid developer, toner particles are prevented from being left alone and accumulating to form hard dried large-size toner particles in the development unit and the cleaning unit in the wet-type image formation apparatus for an extended period of time. As a result, the occurrence of abnormal images, such as white narrow stripes in a black solid, can be prevented.

However, such silicone oils with a siloxane structure are relatively poor in image fixing performance. To improve the image-fixing performance thereof, it is necessary to elevate the temperature of a heat-application roller in an image fixing unit of the copying apparatus.

To elevate the temperature of the heat-application roller in the image fixing unit, however, a considerable amount of the electrical power is consumed. This will inconveniently restrict the attachment of various peripheral devices to the copier because the electrical capacity is limited in the space where the copier is located.

In addition to the above, the cost of the silicone oil with a siloxane structure is generally high, so that the total cost is considerably increased when the above-mentioned silicone oil is used alone as the carrier liquid for the liquid developer.

Furthermore, when the silicone oil with a siloxane structure is used alone as a carrier liquid for the liquid developer, the circulating means for the liquid developer tends to be clogged because of its relatively high viscosity.

SUMMARY OF THE INVENTION

Accordingly, an object of the present invention is to provide a wet-type image formation apparatus, free from the conventional shortcomings, capable of yielding excellent images without abnormality for an extended period of time.

Another object of the present invention is to provide a wet-type image formation apparatus, capable of yielding excellent images without generating an unpleasant odor.

The above-mentioned objects of the present invention can be achieved by a wet-type image formation apparatus comprising a latent electrostatic image formation means capable of forming on a latent-electrostatic-image-bearable photoconductive member a latent electrostatic image corresponding to an original image; and a wet-type development means capable of developing the above-mentioned latent electrostatic image into a visible toner image with a liquid developer which comprises (i) a carrier liquid comprising a petroleum aliphatic hydrocarbon and a silicone oil with a siloxane structure, and (ii) toner particles comprising a coloring agent and a binder resin, which are dispersed in the carrier liquid.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

In the wet-type image formation apparatus according to the present invention, a liquid developer is used, which comprises (i) a carrier liquid comprising a petroleum aliphatic hydrocarbon and a silicone oil with a siloxane structure, and (ii) toner particles comprising a coloring agent and a binder resin, which are dispersed in the above-mentioned carrier liquid.

As the above-mentioned silicone oil with a siloxane structure, for example, methylphenyl polysiloxane can be mixed with a petroleum aliphatic hydrocarbon to prepare a carrier liquid. When the methylphenyl polysiloxane, which evaporates relatively slowly, is used as one component of the carrier liquid for a liquid developer, toner particles can be prevented from quickly getting dry because the evaporation speed of the carrier liquid is significantly decreased. Accordingly, toner particles do not accumulate to form large-size toner particles, which will otherwise cause the occurrence of abnormal images. As previously mentioned, this kind of silicone oil is relatively poor in image-fixing performance. In addition, the viscosity of this silicone oil is relatively high, so that if used alone, this may cause the clogging problem in the circulating means of the liquid developer in the wet-type image formation apparatus. For these reasons, the liquid developer for use in the present invention comprises a petroleum aliphatic hydrocarbon, which shows the superiority in image-fixing performance, and the silicone oil with a siloxane structure. As a result, the wet-type image formation apparatus according to the present invention can produce high quality images over a long period of time without causing an offensive odor.

Figure 1:
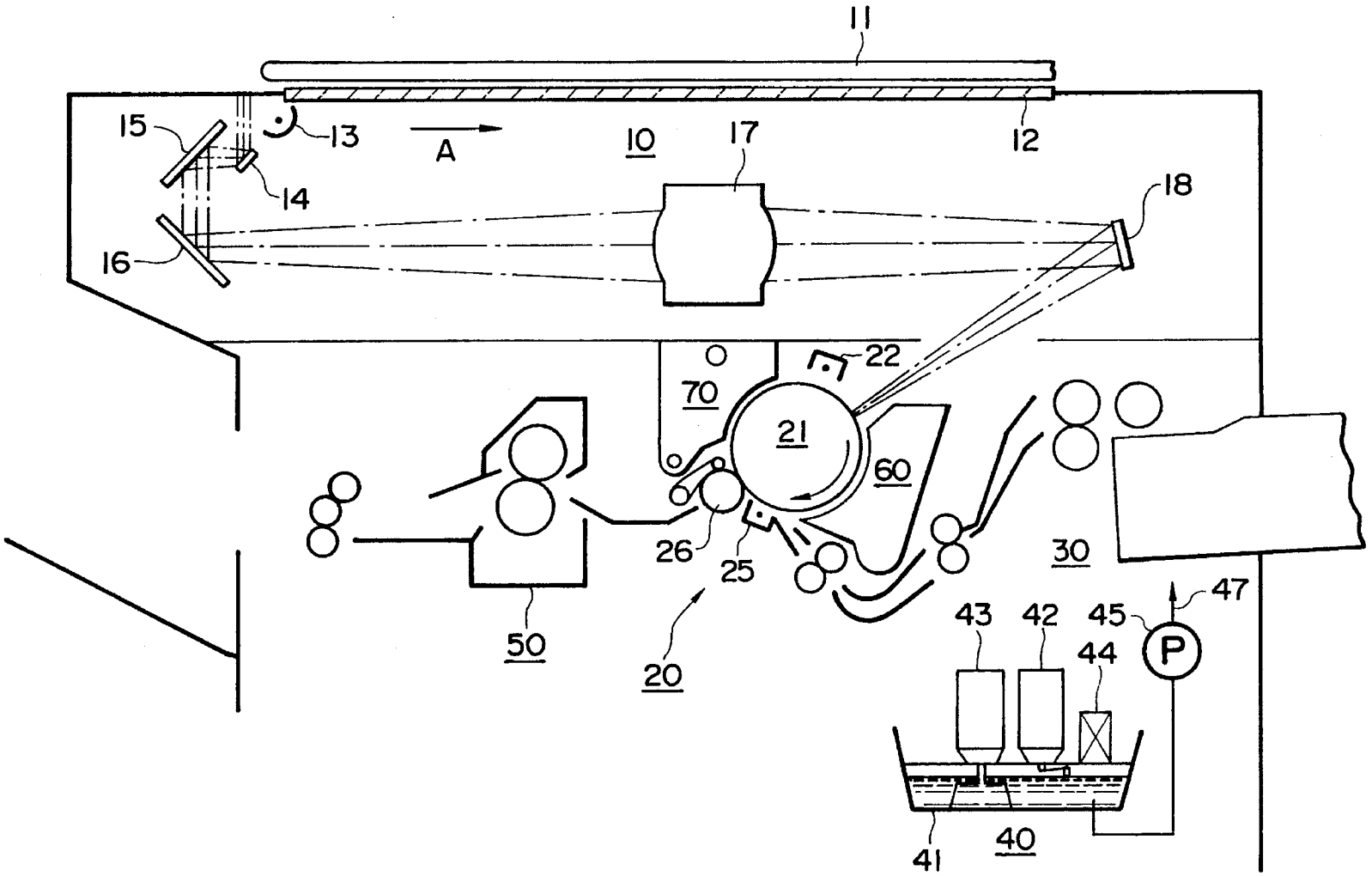
FIG. 1 is a schematic front view of an example of a wet-type image formation apparatus according to the present invention.

FIG. 1 is a schematic diagram of the mechanism in a wet-type electrophotographic copier, one example of the wet-type image formation apparatus according to the present invention.

An optical scanning system 10 is provided at the upper part of the electrophotographic copier as shown in FIG. 1. An image formation unit 20 is positioned below the optical scanning system 10.

An original (not shown) is placed on a contact glass 12 with an image-bearing surface thereof turned to the contact glass 12, and pressed by a pressure-application cover 11. The image-bearing surface of the original is exposed to an exposure lamp 13 which is provided in the optical scanning system 10. The light reflected by the original is passed through a first mirror 14, a second mirror 15, a third mirror 16, a lens unit 17 and a fourth mirror 18, and finally, image formation is achieved at the surface of a photoconductive drum 21 provided in the image formation unit 20.

In the optical scanning system 10, the exposure lamp 13 and the first mirror 14 are mounted on a first carriage (not shown), and the second mirror 15 and the third mirror 16 are mounted on a second carriage (not shown). The first and second carriages are separately driven to scan the original in the direction of the arrow A at a constant speed. The scanning speed of the second carriage is designed to be half the scanning speed of the first carriage. As the first and second carriages proceed, the images formed on the original are sequentially read by scanning through the contact glass 12, and the images read by the optical scanning system 10 are formed into light images on the surface of the photoconductive drum 21.

In the image formation unit 20, the photoconductive drum 21 is rotatably driven in the direction of the arrow at a constant speed. The outer surface of the photoconductive drum 21 is uniformly charged to a predetermined polarity by a main charger 22, and exposed to light images which are converted from the original images by the optical scanning system 10. Corresponding to the light images, latent electrostatic images are formed on the surface of the photoconductive drum 21.

The latent electrostatic images formed on the photoconductive drum 21 are developed to visible toner images while passing through a development unit 60. A liquid developer in the development unit 60 is applied to the latent electrostatic images formed on the photoconductive drum 21, and visible toner images are formed thereon in accordance with the distribution of electric potential.

A sheet of transfer paper (recording sheet) is sent to the photoconductive drum 21 by a paper supply unit 30 synchronously with the formation of the visible toner images on the photoconductive drum 21. The transfer sheet is moved along the photoconductive drum 21, overlapping the visible toner images formed thereon. When the transfer sheet passes a transfer charger 25, the toner images developed on the photoconductive drum 21 are transferred by the aid of the transfer charger 25 to the transfer sheet. The transfer sheet which bears the toner images is separated from the surface of the photoconductive drum 21 by a separation unit 26 and led to an image fixing unit 50 along a predetermined paper path.

In the image fixing unit 50, the toner images transferred to the transfer sheet are fixed thereto by a pressure-application means and a heat-application means. After toner images are fixed to the transfer sheet, the transfer sheet is discharged to a paper discharge tray through a set of paper discharging rollers.

In the image formation unit 20, after separation of the transfer sheet from the surface of the photoconductive drum 21, the residual liquid developer and paper dust deposited on the photoconductive drum 21 are cleared therefrom by a cleaning unit 70 to be ready for the subsequent image formation.

The development unit 60 and the cleaning unit 70 are separately supplied with the liquid developer by a developer supply unit 40. In the developer supply unit 40, the liquid developer stored in a liquid developer reservoir 41 is pumped out by a pump 45, carried through a developer supply pipe 47 and supplied to the development unit 60 and the cleaning unit 70.

A concentrated developer container 42 which contains a concentrated liquid developer, and a diluent container 43 which contains a diluent for diluting the concentrated liquid developer are provided on the liquid developer reservoir 41. The diluent comprises a petroleum aliphatic hydrocarbon and a silicone oil with a siloxane structure, or a petroleum aliphatic hydrocarbon alone.

When the level of the liquid developer in the liquid developer reservoir 41 decreases to a predetermined level as the liquid developer is consumed, the outlet of the diluent container 43 is automatically opened to supply the liquid developer reservoir 41 with the diluent. When the concentration of the toner in the liquid developer decreases in the liquid developer reservoir 41, a solenoid 44 is actuated to open the outlet of the concentrated developer container 42, so that the concentrated liquid developer is supplied to the liquid developer reservoir 41.

Figure 2:
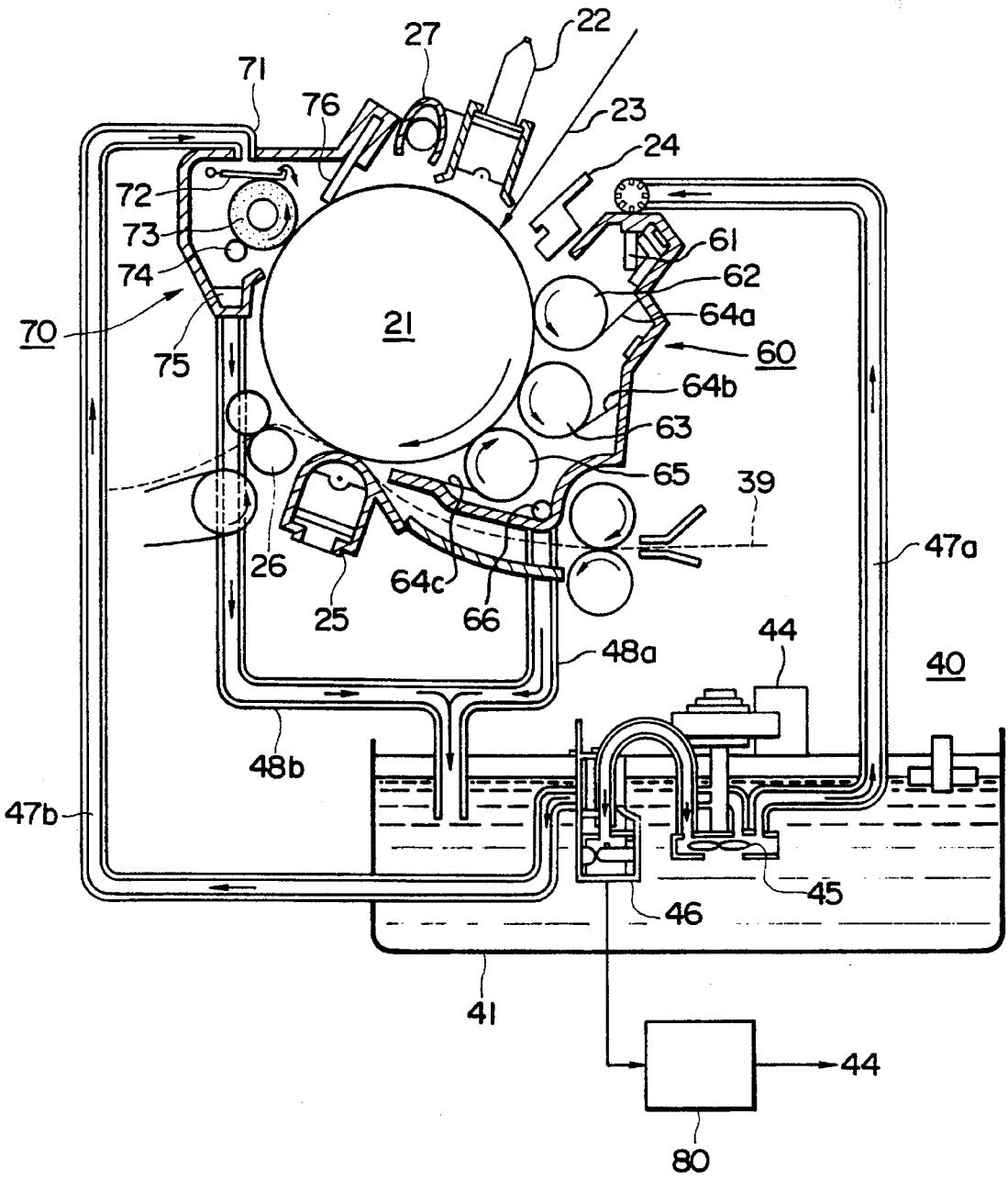
FIG. 2 is an enlarged detailed front view of an image formation unit 20 in the image formation apparatus of FIG. 1.

FIG. 2 is a detailed view of the image formation unit 20 and the developer supply unit 40. In FIG. 2, a first development roller 62, a second development roller 63 and a squeeze roller 65 are driven in rotation in the development unit 60. The first development roller 62 and the second development roller 63 are rotatably driven in the counterclockwise direction, and the squeeze roller 65 is rotatably driven in the clockwise direction. These three rollers, which are electroconductive, are positioned with a slight gap between each roller and the photoconductive drum 21. While the photoconductive drum 21 is rotating, these rollers are also rotated, and when the rotation of the photoconductive drum 21 ceases, the rotation of the development rollers 62 and 63 and the squeeze roller 65 also ceases.

The liquid developer stored in the liquid developer reservoir 41 of the developer supply unit 40 is pumped out by the pump 45, carried through a developer supply pipe **47*a* and supplied to the development unit 40 via a developer supply nozzle 61 which is located at the upper part of the development unit 40. The first development roller 62, the second development roller 63 and the squeeze roller 65 are in contact with the end portion of a scraper 64*a*, a scraper 64*b* and a scraper 64*c*, respectively. The above-mentioned scrapers 64*a*, 64*b* and 64*c* not only serve to scrape the liquid developer off the surfaces of the respective rollers, but also to retain thereon the liquid developer which flows from the above in order to constantly wet the surfaces of the rollers. The liquid developer on the surfaces of the first and second development rollers 62 and 63 is attracted to the electric charge on the photoconductive drum 21 and transported thereto. The excessive liquid developer on the photoconductive drum 21 is removed therefrom by the squeeze roller 65. The unused liquid developer is thus collected and stored in the bottom of the development unit 60. It finally flows into a developer discharge hole 66 by gravity and returns through a developer recovery pipe 48*a* to the liquid developer reservoir 41 of the developer supply unit 40**.

In the cleaning unit 70, the surface of a foam roller 73 covered with sponge and an end portion of a blade 76, which are disposed in contact with the surface of the photoconductive drum 21, serve to scrape the residual liquid developer from the photoconductive drum 21. The liquid developer absorbed by the foam roller 73 is squeezed by a squeeze roller 74 which is in pressure contact with the foam roller 73. The thus collected liquid developer is discharged to the outside through a cleaning developer discharge hole 75 together with the circulating liquid developer for cleaning through a cleaning developer recovery pipe 48*b* to the liquid developer reservoir 41. The above-mentioned liquid developer for cleaning is supplied to the cleaning unit 70 via a cleaning developer supply nozzle 71 located at the upper part of the cleaning unit 70 through a developer supply pipe 47*b* by the developer supply unit 40.

The unused liquid developer remaining in the development unit 60 and the cleaning unit 70 is recovered by circulating through the liquid developer reservoir 41, the development unit 60 and the cleaning unit 70.

In FIG. 2, reference numeral 24 indicates an eraser, which has the function of quenching non-image-formation areas, that is, areas not exposed to light images, on the photoconductive drum 21. Reference numeral 27 indicates a quenching lamp, which serves to quench the residual electric charge of the photoconductive drum 21 to be ready for the subsequent copying operation.

Figure 4A:
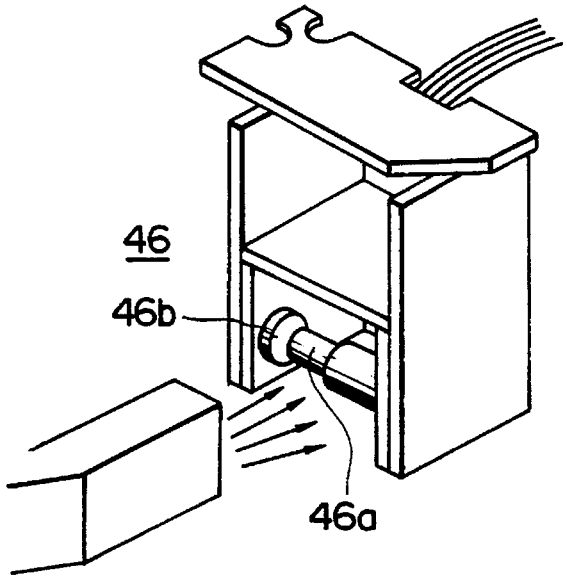
FIGS. 4(*a*) and 4(*b*) are a perspective view and a front view of a toner concentration detector 46 as illustrated in FIG. 2.
Figure 4B:
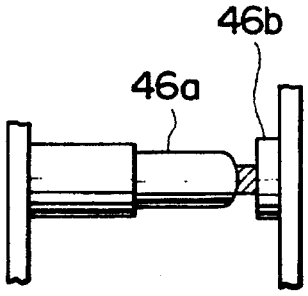

In the developer supply unit 40, the liquid developer circulating in the above-mentioned manner is caused to pass through the inside of a toner concentration detector 46. The toner concentration detector 46 is equipped with a light-emitting element 46*a* and a light-receiving element 46*b*, which are designed to face to each other with a slight gap of about 0.5 to 1.0 mm therebetween. When the liquid developer passes between the light-emitting element 46*a* and the light-receiving element 46*b* in the direction of the arrow as shown in FIG. 4(*a*), the toner concentration detector 46, which is provided with a light-transmission type optical sensor, detects the toner concentration signals corresponding to the amount of light transmitted through the liquid developer.

The toner concentration signals detected by the toner concentration detector 46 are input to a toner concentration control unit 80 in FIG. 2. The thus input data for the concentration of the toner contained in the liquid developer is checked by the concentration control unit 80 at regular intervals. When the concentration of the toner does not reach a predetermined value, the solenoid 44 is actuated by the concentration control unit 80 to open the outlet of the concentrated developer container 42 for a fixed time for replenishment. As a result of this control, the concentration of the toner in the liquid developer stored in the liquid developer reservoir 41 can be maintained within the predetermined range.

Figure 3:
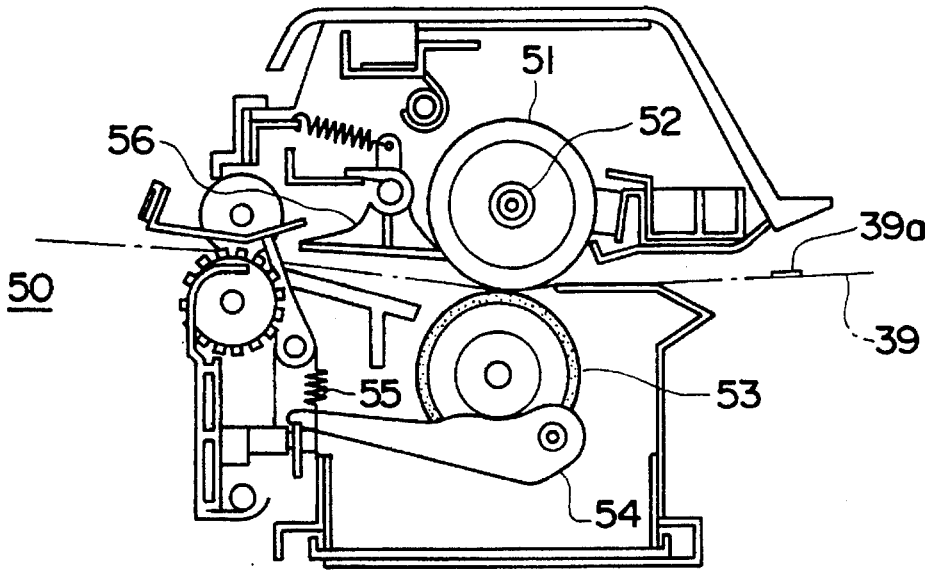
FIG. 3 is an enlarged detailed front view of an image fixing unit 50 in the image formation apparatus of FIG. 1.

FIG. 3 is a schematic view of the image fixing unit 50 of the wet-type image formation apparatus according to the present invention, which is schematically illustrated in FIG. 1.

In the image fixing unit 50 as shown in FIG. 3, a heat-application roller 51 with a built-in heater 52 and a pressure-application roller 53 are provided, with a path for the transfer sheet 39 provided therebetween. The transfer sheet which bears a toner image 39*a* is caused to pass between the two rollers for image fixing performance, with a pressure applied thereto in an upward direction by the pressure-application roller 53 through a pressure-application cam 54, which is actuated by a pressure-application spring 55. The transfer sheet is then separated from the rollers by the aid of a sheet-separation pawl 56.

In the wet-type copying apparatus with the above-mentioned structure, as previously mentioned, a liquid developer prepared by dispersing a coloring agent and a binder resin in a petroleum aliphatic hydrocarbon, for instance, "Isopar H", made by Exxon Chemical Japan Ltd., serving as a carrier liquid is conventionally used. The reason for this is that the above-mentioned petroleum aliphatic hydrocarbon has adequate image-fixing performance to obtain high quality copy images.

However, when the petroleum aliphatic hydrocarbon is used alone as the carrier liquid for the liquid developer, the following problems are produced because its evaporation is relatively rapid:

(1) The toner particles which have not been transferred to the transfer sheet are collected in the cleaning unit, and the toner particles which have been deposited to the development rollers are scraped off the rollers by scrapers and collected in the development unit, and they are mostly returned to a liquid developer reservoir by use of a circulating system and uniformly dispersed again in the carrier liquid to prepare a liquid-type developer with a predetermined concentration. When the petroleum aliphatic hydrocarbon is used alone as the carrier liquid for the liquid developer, part of the toner particles are left alone in the cleaning unit and the development unit because the above-mentioned petroleum aliphatic hydrocarbon easily evaporates. As the progress of evaporation of the carrier liquid for an extended period of time, only the toner particles accumulate just like sludge. These sludgy toner particles are usually washed away by the flow of the circulating liquid developer for cleaning, thereby returning to the liquid developer reservoir. However, the sludgy toner particles are deposited over an extended period of time in a dead space where the flow of the circulating liquid developer for cleaning is weak. In the case where the copying operation ceases for a long time, the water component of the sludgy toner particles gradually evaporates, and finally they are agglomerated in the form of a flake, so that they will not easily be dispersed again in the carrier liquid. The diameter of the toner particle thus formed in a flake is as large as 1 to 500 μm, when compared with a normal toner particle having a diameter of 0.5 to 0.8 μm, so that these toner particles in the form of a flake, which do not contribute to the development, are caught in the gap between development rollers and the photoconductor, which is designed to have a distance of 100 to 150 μm. This causes abnormal images, such as white narrow stripes on a solid image.

(2) For example, when the copying apparatus is moved, it is necessary to take out the liquid developer from the liquid developer reservoir of the copying apparatus to prevent the liquid developer from being spilt outside of the liquid developer reservoir. In the case where the copying apparatus is allowed to stand with the liquid developer not supplied again to the liquid developer reservoir, the liquid developer remaining on the light-emitting element 46*a* and the light-receiving element 46*b* in the toner concentration detector 46 as shown in FIG. 4(*b*) becomes dry and is deposited thereto. The developer thus deposited to the surfaces of the toner concentration detector 46 does not easily come out even though the liquid developer is poured again in the liquid developer reservoir. The light receiving level of the toner concentration detector 46 is therefore drastically attenuated, so that the detector 46 estimates the toner concentration to be much higher than the actual level. When the toner concentration is controlled in accordance with such incorrect detection, the toner concentration is considerably lowered, so that the density of copy images is also decreased.

(3) When the development is performed by use of the liquid developer comprising the petroleum aliphatic hydrocarbon as a carrier liquid, the off-set phenomenon readily occurs in the image-fixing operation. More specifically, part of the toner images transferred to the transfer sheet is deposited to the surfaces of the heat-application roller 51 or the pressure-application roller 53 as shown in FIG. 3. As a result, the image density of the obtained copy images is decreased and the omission is observed on the copy images. In addition to the above, the toner which is deposited to the rollers in the image-fixing unit is re-transferred to the transfer sheet, so that the transfer sheet is stained with the toner. To prevent the above-mentioned off-set phenomenon, a silicone rubber is used for the surface of the rollers in the image-fixing unit, or a silicone oil is constantly applied to the rollers. The silicone rubber used for the rollers is, however, relatively poor in the heat-resistance and durability, so that it must be regularly replaced by a new one according to the degree of deterioration thereof. To apply the silicone oil to the surfaces of the rollers, the configuration of the image-fixing unit inevitably becomes complicated.

To solve the above-mentioned problems, the mixture of the petroleum aliphatic hydrocarbon and the silicone oil with a siloxane structure is used as the carrier liquid for the liquid developer.

Because of the use of the silicone oil with a siloxane structure, the liquid developer does not easily evaporate. This prevents the toner particles from accumulating to form a flake. Further, the toner does not remain deposited to the toner concentration detector. In addition, the off-set phenomenon can be prevented in the image-fixing operation due to the silicone oil with a siloxane structure. The heat-application roller and pressure-application roller may be therefore made of other materials than the silicone rubber, and the silicone oil may not be applied to the rollers.

Since the carrier liquid for the developer for use in the present invention also contains the petroleum aliphatic hydrocarbon, the image-fixing performance can satisfactorily be maintained.

In the image fixing unit of the wet-type image-formation apparatus according to the present invention as shown in FIG. 3, the heat-application roller 51, the pressure-application roller 53 and the pressure-application cam 54, of which drum substrates are made of aluminum, can be coated with Teflon (Trademark), made by Du Pont de Nemours, E.I. & Co., which is superior over the silicone rubber in the heat-resistance and durability. Furthermore, the means for constantly applying the silicone oil to the surfaces of the above-mentioned rollers can be omitted.

Using a commercially available wet-type copying apparatus, "CT-5085" (Trademark), made by Ricoh Company, Ltd., one example of the wet-type image-formation apparatus according to the present invention with such a structure as shown in FIG. 1, an image-formation test was carried out under the following conditions:

Toner: toner for the copying apparatus "CT-5085"

Developer: separately prepared by dispersing 100 g of the above toner in 1ι of the respective carrier liquids as shown in Table 2.

Transfer sheet: Plain transfer sheet "Type 6200" (Trademark), made by Ricoh Company, Ltd. A4-size.

Test conditions: Using an original having a solid area of 15%, 500 to 1000 copies per day were continuously made for 22 days.

The results of the image-formation test are given in Table 2.

TABLE 2

| Type of Carrier Liquids *** | Image Density Initial Stage* | Image Density Final Stage** | Image Quality **** | Presence of Abnormal Toner ***** |
|---|---|---|---|---|
| Isopar G | 1.48 | 1.31 | 1 | A |
| Isopar H | 1.50 | 1.35 | 1 | A |
| Isopar L | 1.48 | 1.40 | 3 | B |
| Sample A | 1.51 | 1.48 | 5 | C |
| Sample B | 1.51 | 1.47 | 5 | C |
| Sample C | 1.52 | 1.42 | 5 | C |
| Sample D | 1.50 | 1.44 | 5 | C |
| Sample E | 1.49 | 1.41 | 5 | C |

*measured immediately after the image-formation test was started on the first day.
**measured after the image-formation test was finished on the 22nd day.
***Sample A: Polymethyl siloxane-(100 vol.%)
Sample B: Isopar H/polymethylphenyl siloxane (95/5)
Sample C: Isopar H/polymethylphenyl siloxane (90/10)
Sample D: Isopar H/polymethylphenyl siloxane (85/15)
Sample E: Isopar H/polymethylphenyl siloxane (80/20)
****Rank of Image Quality
5: No white stripes was observed in a black solid.
4: One white stripe was observed in a black solid.
3: Three white stripes were observed in a black solid.
2: Three or more white stripes were strikingly observed in a black solid.
1: Five or more white stripes were strikingly observed in a black solid.
*****Presence of Abnormal Toner
A: A large quantity of flake-shaped toner particles was observed in the liquid developer.
B: A small quantity of flake-shaped toner particles was observed in the liquid developer.
C: No flake-shaped toner was observed in the liquid developer.

As can be seen from the results in Table 2, the deterioration in the image quality caused by the flaked-shape large-size toner particles remaining in the development unit and the cleaning unit can be prevented when the carrier liquid for the liquid developer contains the polymethylphenyl siloxane in an amount ratio of at least 5 vol.%. This is because the evaporation of the silicone oil with a siloxane structure, such as polymethylphenyl siloxane, is relatively slow, as compared with that of the petroleum aliphatic hydrocarbon. It is considered that the sludgy toner can be returned to the liquid developer reservoir and dispersed again in the carrier liquid before the sludgy toner completely dries up.

When the sample carrier liquids A to E were used, toner particles were not deposited to the rotating shafts of the development rollers and the cleaning rollers, so that the load torque applied to the rotating shafts of these rollers was not increased. In fact, by use of-the sample carrier liquids A to E, the load torque in the cleaning unit was decreased by about 15%, when compared with the case where the conventional petroleum aliphatic hydrocarbon was used alone as the carrier liquid. Furthermore, the toner particles which did not contribute to the development performance were decreased, thereby increasing the potential copy-making capacity per weight unit of toner.

Figure 8A:
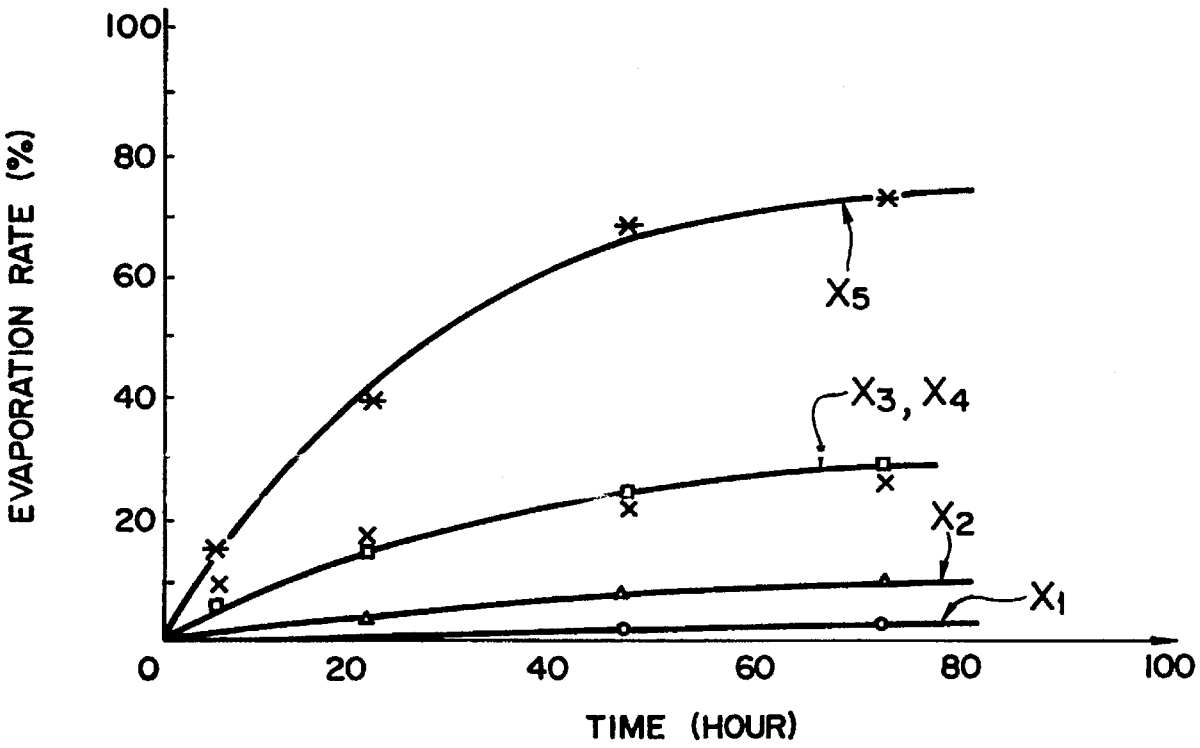
FIGS. 8(*a*) and 8(*b*) are graphs showing the evaporation characteristics of various carrier liquids.
Figure 8B:
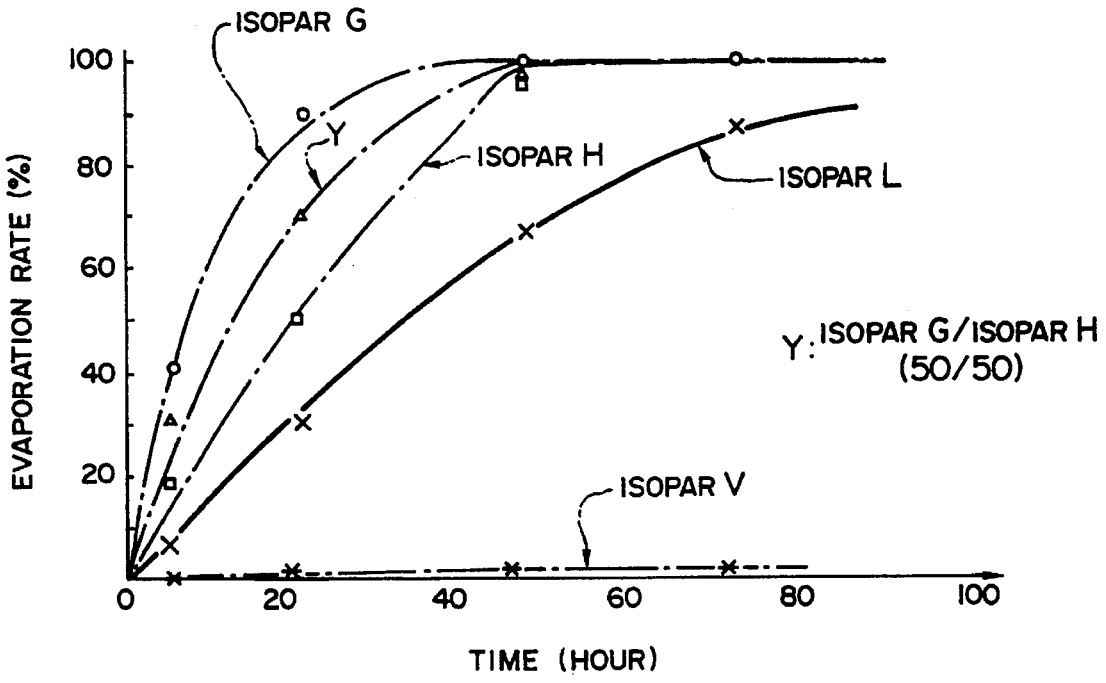

FIG. 8(*a*) is a graph showing the evaporation rate of each carrier liquid in which a commercially available silicone oil with a siloxane structure, "KF-58" (Trademark), made by Shin-Etsu Polymer, Co., Ltd., is contained at a different mixing ratio. The evaporation rate of the carrier liquid varies depending on the mixing ratio of the silicone oil with a siloxane structure therein.

FIG. 8(*b*) is a graph showing the evaporation rate of various types of petroleum aliphatic hydrocarbons, commercially available under the name of "Isopar".

As is apparent from the above two graphs, the evaporation of the carrier liquid which comprises both the silicone oil with a siloxane structure ("KF-58") and the petroleum aliphatic hydrocarbon ("Isopar H") is slow, as compared with that of the single carrier liquid "Isopar H".

It is apparent from FIG. 8(*b*) that evaporation of "Isopar V" is very slow, but the viscosity thereof is as high as 11.9 cs, when compared with the viscosity of "Isopar H" of 1.13. Accordingly, it is difficult to use "Isopar V" alone as the carrier liquid in the practical use.

Using a commercially available wet-type copying apparatus, "CT-5085" (Trademark), made by Ricoh Company, Ltd., one example of the wet-type image-formation apparatus according to the present invention with such a structure as shown in FIG. 1, a toner-deposition test was carried out to evaluate the degree of the toner deposition to the toner concentration detector 46 as shown in FIG. 4(*b*) in such a fashion that the toner concentration detector 46 was immersed in the respective liquid developers which were separately prepared by dispersing 100 g of the toner for the copying apparatus "CT-5085" in 1ι of the respective carrier liquids as shown in Table 3 at 25±1° C. for 2 weeks.

The results of the toner-deposition test are given in Table 3.

TABLE 3

| Type of Carrier Liquids* | Toner Deposition to Detector** | Response Ratio of Detector*** |
|---|---|---|
| Isopar E | X | 2(%) |
| Isopar G | X | 2.5 |
| Isopar H | X | 2.5 |
| Isopar K | X | 4 |
| Isopar L | X | 8 |
| Isopar M | Δ | 19 |
| Sample I | o | 98 |
| Sample II | o | 99 |
| Sample III | o | 98 |
| Sample IV | o | 98 |
| Sample V | o | 96 |
| Sample VI | o | 99 |
| Sample VII | o | 99 |
| Sample VIII | o | 96 |

*Sample I : Dimethyl siloxane (100 vol. %)
Sample II : Methylphenyl siloxane (100 vol. %)
Sample III : Isopar H/dimethyl siloxane (95/5)
Sample IV : Isopar H/dimethyl siloxane (90/10)
Sample V : Isopar H/dimethyl siloxane (75/25)
Sample VI : Isopar H/methylphenyl siloxane (95/5)
Sample VII : Isopar H/methylphenyl siloxane (90/10)
Sample VIII : Isopar H/methylphenyl siloxane (75/25)
**Toner Deposition to Detector: After the toner concentration detector was immersed for 2 weeks, it was placed in the liquid developer reservoir. With 500 ml of the liquid developer flowing in the liquid developer reservoir over a period of 1 minute, the degree of toner deposition to the toner concentration detector was visually inspected and assessed in accordance with the following scale.
o: Toner particles were not at all deposited to any surfaces of the detector.
Δ: Toner particles were partially deposited to the detector, but the detector normally operated to detect the toner concentration.
X: Toner particles were deposited to all the surfaces of the detector.
***Response Ratio of Detector: The ratio of the response performance of the detector after the test to that obtained before the test.

As can be seen from the results in Table 3, Samples I to VIII produced satisfactory results with respect to the toner deposition to the toner concentration detector. This is because the evaporation of these carrier liquids is relatively slow.

Using three kinds of liquid developers which were separately prepared by dispersing a toner in the following carrier liquids, an off-set test was carried out by elevating the temperature of the heat-application roller in the image-fixing unit, to find a minimum temperature at which the off-set phenomenon occurred.

The test conditions were as follows:

(a) The materials for the surfaces of the heat-application roller and pressure application roller in the image-fixing unit: Polytetrafluoroethylene (PTFE) and perfluoroalkoxy (PFA)

(b) Treatment of the above-mentioned rollers: Application of the silicone oil thereto. (c) The kinds of carrier liquids:

A: Isopar H/methylphenyl polysiloxane (20/80)

B: Isopar H/methylphenyl polysiloxane (60/40)

C: Isopar H (100 vol.%)

Figure 5:
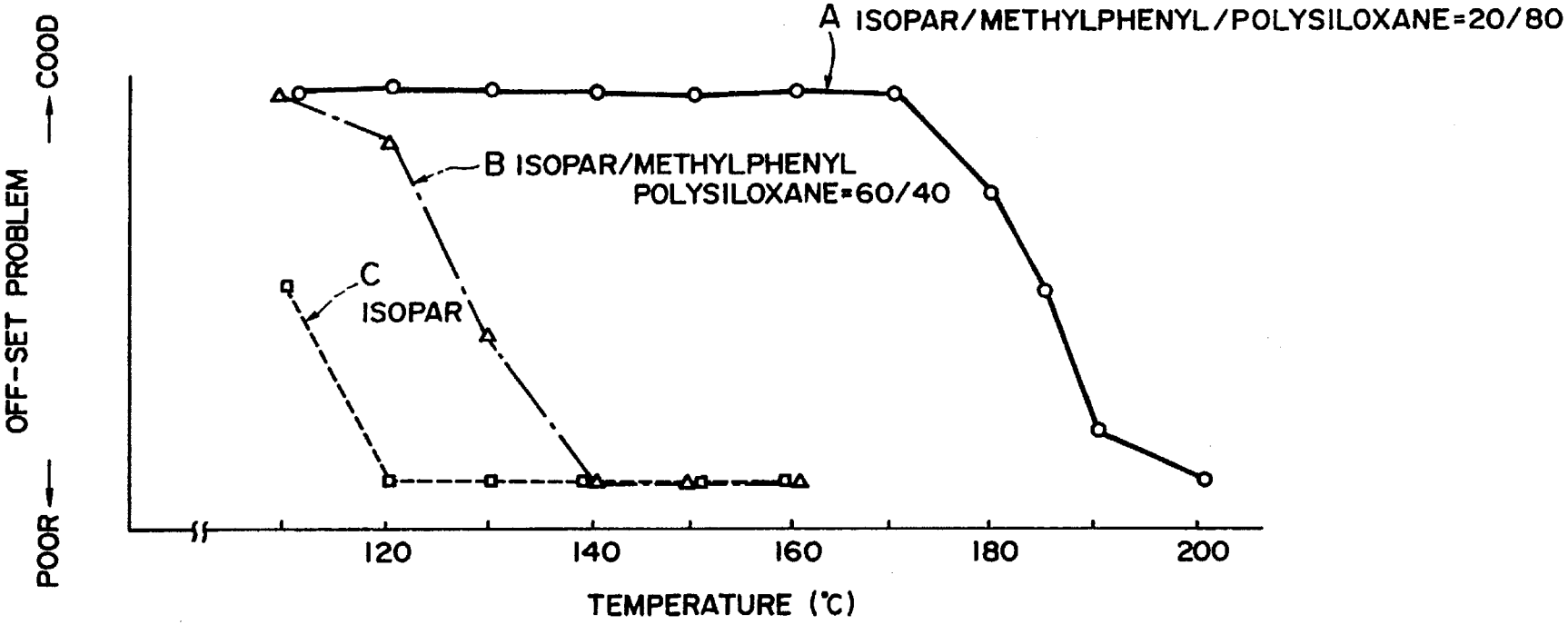
FIG. 5 is a graph showing the results of an off-set test using three types of liquid developers.

The results of the off-set test are given in FIG. 5.

As can be seen from the graph in FIG. 5, when the carrier liquid C was used for the developer, the off-set phenomenon often occurred at a temperature as low as about 110° C., and the high quality images were not obtained. To employ the carrier liquid C for the developer, the rollers in the image-fixing unit must be coated with a silicone rubber as conventionally done. However, the silicone rubber is poor in the heat-resistance and the durability, so that it must be replaced by a new one regularly.

With reference to FIG. 5, the off-set problem can be solved by using the carrier liquid comprising the petroleum aliphatic hydrocarbon ("Isopar") and the silicone oil with a siloxane structure (methylphenyl polysiloxane). Even though the temperature of the heat-application roller was elevated to 170° C., the off-set phenomenon did not occur and high quality images were obtained when the carrier liquid A was used.

Figure 6:
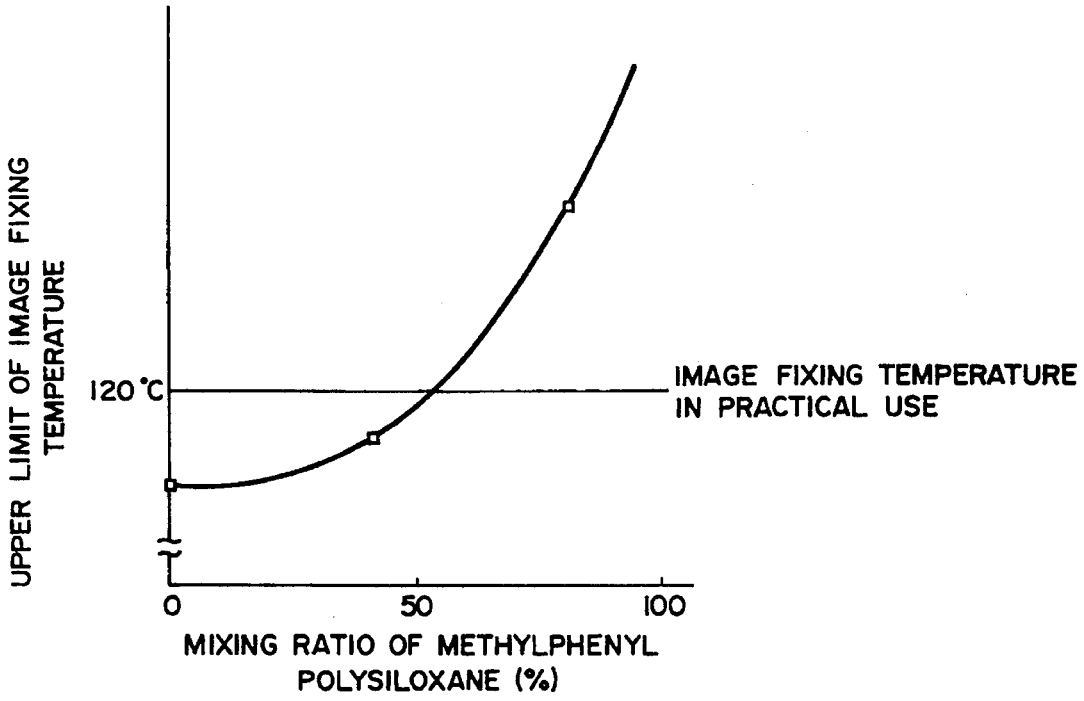
FIG. 6 is a graph showing the relationship between the mixing amount ratio of methylphenyl polysiloxane in the carrier liquid and the upper limit of the image fixing temperature.
Figure 7:
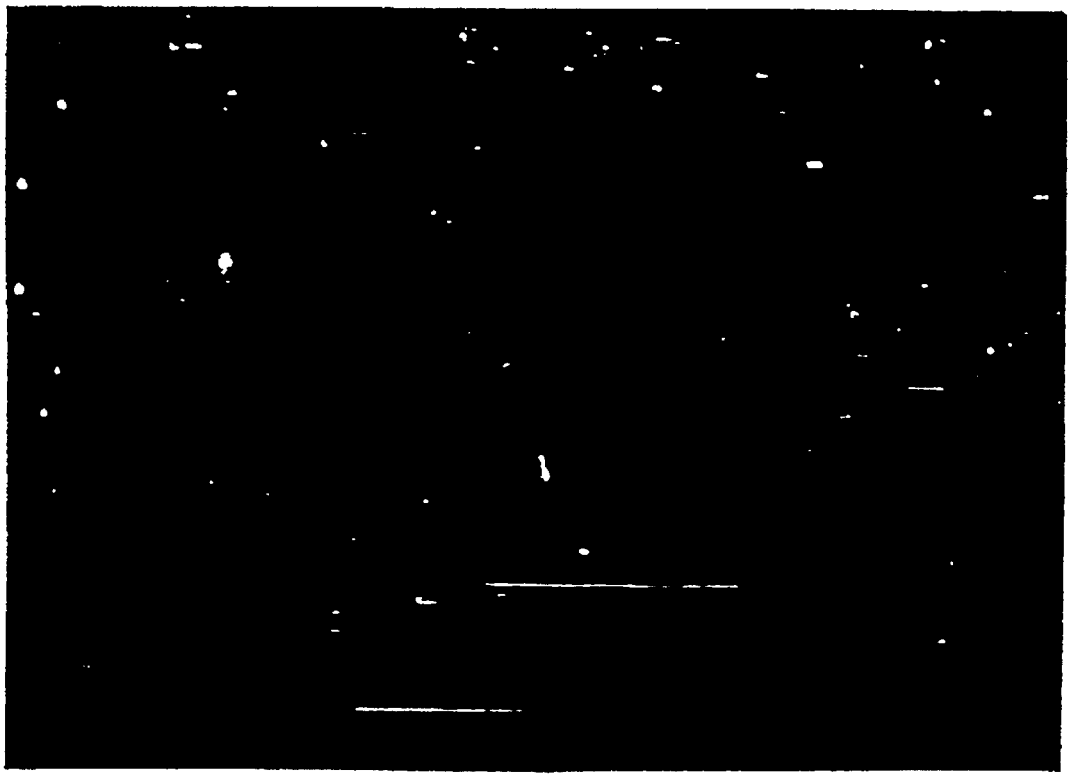
FIG. 7 is an enlarged plan view of a black solid image with white narrow stripes.

FIG. 6 is a graph showing the relationship between the mixing amount ratio of the methylphenyl polysiloxane in a carrier liquid and the upper limit of the temperature of a heat-application roller in the image-fixing unit. For instance, in a copying apparatus in which the image-fixing operation is performed at 120° C., the off-set problem can be solved by using a mixed carrier liquid of a petroleum aliphatic hydrocarbon "Isopar" and a silicone oil with a siloxane structure (methylphenyl polysiloxane), with the latter contained in an amount ratio of 50 vol.% or more. As the image-fixing temperature is increased, it is required to increase the content of the methylphenyl polysiloxane.

Furthermore, the procedure for the above-mentioned off-set test was repeated except that the silicone oil was not applied to the rollers in the image-fixing unit. It was found that the upper limit of the image-fixing temperature be decreased by about 10° to 20° C. When the content of the silicone oil (methylphenyl polysiloxane) is sufficient in the carrier liquid for the developer, the off-set phenomenon does not occur even though the silicone oil is not applied to the rollers in the image-fixing unit.

In addition to the above, when the content of the silicone oil (methylphenyl polysiloxane) is sufficiently increased in the carrier liquid, it is not necessary to coat the rollers in the image-fixing unit with the silicone rubber. Instead of the silicone rubber, the above-mentioned fluoroplastics, PTFE and PFA, which have the improved heat-resistance and durability, can be used for the rollers in the image-fixing unit. Accordingly, it does not need the replacement of the parts of the rollers.

In the present invention, the silicone oil with a siloxane structure which has a boiling point of 230° C. or less, or a viscosity of 4.0 cs or less is preferably used for the carrier liquid in order to minimize the unpleasant odor caused by the evaporation of the carrier liquid in the image fixing operation, and to obtain excellent image fixing performance.

Using a commercially available wet-type copying apparatus, "CT-5085" (Trademark), made by Ricoh Company, Ltd., one example of the wet-type image-formation apparatus according to the present invention with such a structure as shown in FIG. 1, the image-formation test was carried out in such a fashion that the copying operation was continuously performed using an original having a chart area of 7%.

Other test conditions were as follows;

Toner: a thermal crosslinking toner as disclosed in Japanese Laid-Open Patent Application 63-303382.

Developer: separately prepared by dispersing 100 g of the above toner in 1ι of the respective carrier liquids as shown in Table 4.

Transfer sheet: Plain transfer sheet "Type 6200" (Trademark), made by Ricoh Company, Ltd. A4-size.

Linear velocity of transfer sheet: 270 mm/sec

Electric power for a heater built in a heat-application roller in the image-fixing unit: 700 w Surface temperature of the heat-application roller: 180±10° C.

The results of the image-formation test are given in Table 4.

TABLE 4

| Type of Carrier Liquids * | Boiling Point (°C.) | Viscosity (cs) | Molecular Weight or Number of Molecules | Unpleasant Odor ** | Image-fixing Performance*** |
|---|---|---|---|---|---|
| Sample 1 | 153 | 1.0 | 237 | 5 | o(1.51) |
| Sample 2 | — | — | — | 4.5 | o(1.53) |
| Sample 3 | — | — | — | 3 | o(1.48) |
| Sample 4 | 229 | 2.0 | 385 | 5 | Δ(1.46) |
| Sample 5 | — | — | — | 4.5 | Δ(1.48) |
| Sample 6 | — | — | — | 3 | o(1.44) |
| Sample 7 | 250 | 5.0 | 682 | 5 | X(1.42) |
| Sample 8 | — | — | — | 4 | X(1.44) |
| Sample 9 | — | — | — | 3 | X(1.46) |
| Sample 10 | 175 | 2.3 | tetramer | 5 | o(1.51) |
| Sample 11 | — | — | tetramer | 4.5 | o(1.53) |
| Sample 12 | — | — | tetramer | 3 | o(1.48) |
| Sample 13 | 210 | 4.0 | pentamer | 5 | Δ(1.46) |
| Sample 14 | — | — | pentamer | 4.5 | Δ(1.48) |
| Sample 15 | — | — | pentamer | 3 | o(1.44) |
| Sample 16 | 250 | 6.8 | hexamer | 5 | X(1.42) |
| Sample 17 | — | — | hexamer | 4 | X(1.44) |
| Sample 18 | — | — | hexamer | 3 | X(1.46) |

Sample 1: KF96L-1.0/Isopar H (100/0)
Sample 2: KF96L-1.0/Isopar H (50/50)
Sample 3: KF96L-1.0/Isopar H (20/80)
Sample 4: KF96L-2.0/Isopar H (100/0)
Sample 5: KF96L-2.0/Isopar H (50/50)
Sample 6: KF96L-2.0/Isopar H (20/80)
Sample 7: KF96L-5.0/Isopar H (100/0)
Sample 8: KF96L-5.0/Isopar H (50/50)

TABLE 4-continued

Sample 9: KF96L-5.0/Isopar H (20/80)
Sample 10: KF994/Isopar H (100/0)
Sample 11: KF994/Isopar H (50/50)
Sample 12: KF994/Isopar H (20/80)
Sample 13: KF995/Isopar H (100/0)
Sample 14: KF995/Isopar H (50/50)
Sample 15: KF995/Isopar H (20/80)
Sample 16: KF996/Isopar H (100/0)
Sample 17: KF996/Isopar H (50/50)
Sample 18: KF996/Isopar H (20/80)

In the above, "KF96L-1.0", "KF96L-2.0" and "KF96L-5.0" are commercially available silicone oils with a dimethyl siloxane structure, and "KF994", "KF995" and "KF996" are commercially available silicone oils with a cyclic siloxane structure, made by Shin-Etsu Chemical Co., Ltd. "Isopar H" is a commercially available petroleum aliphatic hydrocarbon, made by Exxon Chemical Japan Ltd.

** Unpleasant Odor: measured by an organoleptic examination after continuous copying operation over a period of 15 minutes in a 30 $m^2$-operation room without ventilation, and assessed in accordance with the following scale.

5: no odor
4: faint odor
3: distinct odor
2: strong odor
1: extremely strong odor

***Image-fixing Performance: the obtained images were rubbed immediately after a toner-image-bearing transfer sheet was discharged and assessed by the degree of smear of the image in accordance with the following scale. The figures in parentheses indicate the image density.

o: no smear
Δ: permissible slight smear
X: marked smear

As can be seen from Table 4, the following facts are proved;

(1) In the liquid developer prepared by dispersing toner particles in a carrier liquid which comprises a petroleum aliphatic hydrocarbon and a silicone oil with a siloxane structure, the silicone oil having a boiling point of 230° C. or less is preferable from the viewpoint of the image-fixing performance. In addition, it is preferable that the above silicone oil be contained in the carrier liquid in an amount ratio of 50 vol.% or more to less than 100 vol.% from the viewpoint of prevention of an unpleasant odor.

(2) In the liquid developer prepared by dispersing toner particles in a carrier liquid which comprises a petroleum aliphatic hydrocarbon and a silicone oil with a siloxane structure, the silicone oil having a viscosity of 4.0 cs or less is preferable from the viewpoint of the image-fixing performance. In addition, it is preferable that the above silicone oil be contained in the carrier liquid in an amount ratio of 50 vol.% or more to less than 100 vol.% from the viewpoint of prevention of an unpleasant odor.

(3) In the liquid developer prepared by dispersing toner particles in a carrier liquid which comprises a petroleum aliphatic hydrocarbon and a silicone oil with a siloxane structure, the silicone oil with a dimethyl siloxane structure or cyclic siloxane structure is preferable.

(4) It is preferable that the silicone oil with a dimethyl siloxane structure have a boiling point of 230° C. or less, a viscosity of 2.5 or less, and a molecular weight of 385 or less. In addition, the above-mentioned silicone oil with a dimethyl siloxane structure be contained in the carrier liquid in an amount ratio of 50 vol.% or more to less than 100 vol.%.

(5) It is preferable that the silicone oil with a cyclic siloxane structure have a viscosity of 4.0 or less, and be a trimer, a tetramer or a pentamer. In addition, the above-mentioned silicone oil with a cyclic siloxane structure be contained in the carrier liquid in an amount ratio of 50 vol.% or more to less than 100 vol.%.

With respect to the boiling point of the silicone oil with a siloxane structure, when the silicone oil having a boiling point of 230° C. or less (samples 1, 2, 3, 4, 5, 6, 10, 11, 12, 13, 14 and 15) was used for the carrier liquid, the image-fixing performance was almost satisfactory at the image-fixing temperature of 180° C.

The silicone oil with a siloxane structure having a boiling point of 230° C. or more seems to be usable if the temperature of the heat-application roller is elevated to 180° C. or more. However, this has the drawbacks that the durability of the heat-application roller is shortened, a large quantity of the electric power is consumed, and the safety is not ensured.

As previously mentioned, the evaporation of the silicone oil with a siloxane structure is relatively slow, so that toner particles are not left alone in the form of a flake in the development unit and the cleaning unit when the silicone oil is used as the carrier liquid for the liquid developer in the wet-type image formation apparatus. However, the above-mentioned silicone oil is poor in the image-fixing performance. Therefore, it is used together with the petroleum aliphatic hydrocarbon which is superior in the image-fixing performance.

As previously mentioned, the carrier liquid for use in the present invention comprises a silicone oil with a siloxane structure and a petroleum aliphatic hydrocarbon. For example, the polydimethyl siloxane and isoparaffin can be used as the silicone oil with a siloxane structure and the petroleum aliphatic hydrocarbon, respectively. In addition, it is preferable that the above-mentioned polydimethyl siloxane be contained in the carrier liquid in an amount ratio of 50 vol.% or more to less than 100 vol.%.

The polydimethyl siloxane for use in the present invention has the following formula:

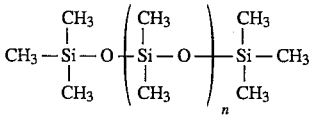

The viscosity of the polydimethyl siloxane having the above-mentioned formula varies depending on the number of n in the formula.

As the commercially available polydimethyl siloxane for use in the present invention, "KF96L" (viscosity of 0.65 cs), "KF-96L" (viscosity of 1 cs) and "KF96L" (viscosity of 2 cs), made by Shin-Etsu Polymer Co., Ltd.; and "SH200" (viscosity of 1 cs) and "SH-200" (viscosity of 1.5 cs), made by Toray Silicone Co., Ltd., can be employed.

The above polydimethyl siloxane has excellent thermal stability. Furthermore, in the case where the polydimethyl siloxane is used as the carrier liquid for a liquid developer, no oxide which will cause an unpleasant odor are generated therefrom when it is brought into contact with a heat-application roller which is heated for image fixing. Accordingly, it does not cause any environmental pollution problems. The liquid developer comprising a carrier liquid which contains at least polydimethyl siloxane is regarded as advantageous from the viewpoint of hygiene.

The aforementioned polydimethyl siloxane for use in the present invention has the advantage that evaporation loss is extremely small over the isoparaffin as the carrier liquid.

The superiority of the polydimethyl siloxane as the carrier liquid for the liquid developer to the conventional ones can be demonstrated in particular when a large number of copies are made at high speed.

It is preferable that the viscosity of the above-mentioned polydimethyl siloxane be 1 cs or less. The polydimethyl siloxane having a viscosity of 1 cs or less inclines to bubble when used as the carrier liquid, but the influence on the image formation is so slight in the practical use.

In the case where the viscosity of the polydimethyl siloxane can be maintained at 1 cs or less by application of heat when it is used as the carrier liquid even though its viscosity exceeds 1 cs at room temperature, the adverse influence of bubbling can be avoided in the practical use. To heat the carrier liquid, for example, a heater can be provided in the liquid developer reservoir.

Examples of the commercially available isoparaffin are "Isopar L" (boiling point of 188° to 210° C.), "Isopar M" (boiling point of 205° to 252° C.), "Isopar G" (boiling point of 158° to 177° C.) and "Isopar H" (boiling point of 174° to 190° C.), made by Exxon Chemical Japan Ltd.; "IP Solvent 2028" (boiling point of 210° to 265° C.), "IP Solvent 2835" (boiling point of 275° to 350° C.) and "IP Solvent 1620" (boiling point of 166° to 205° C.), made by Idemitsu Petrochemical Co., Ltd.; "Nisseki Isosol 400" (boiling point of 206° to 257° C.), made by Nippon Petrochemicals Co., Ltd.; and "Isododecane" (boiling point of 176° to 185° C.), made by BP Far East Ltd. In addition to the above, isooctane and ligroin, both having a boiling point ranging from 120° to 190° C. can be used.

It is preferable that the polydimethyl siloxane be contained in the carrier liquid in an amount ratio of 50 vol.% or more to less than 100 vol.%.

In the present invention, conventional toner particles can be dispersed in a carrier liquid comprising polydimethyl siloxane and the isoparaffin.

As previously described, toner particles comprise a coloring agent and binder resin.

Examples of inorganic pigments used as the coloring agent include commercially available "Printex G", "Printex V", "Printex U", "Special Black 15" and "Special Black 4" (made by Degussa Japan Co., Ltd. ); "#44", "#30", "MR-11" and "MA-100" (made by Mitsubishi Carbon Co. ); "Mogul L", "Black Pearl 1300", "Black Pearl 1100", "Black Pearl 900", "Regal 400" and "Regal 660" (made by Cabot Co., Ltd.); and "Neospectra II", "Robin 1035" and "Robin 1252" (made by Columbia Carbon Ltd.).

Examples of organic pigments used as the coloring agent include Phthalocyanine Blue, Phthalocyanine Green, Sky Blue, Rhodamine Lake, Malachite Green Lake, Methyl Violet Lake, Peacock Blue Lake, Naphthol Green B, Naphthol Green Y, Naphthol Yellow S, Naphthol Red, Lithol Fast Yellow 2G, Permanent Red 4R, Brilliant Fast Scarlet, Hansa Yellow, Benzidine Yellow, Lithol Red, Lake Red C, Lake Red D, Brilliant Carmine 6B, Permanent Red F5R, Pigment Scarlet 3B, Indigo, Thioindigo, Oil Pink and Bordeaux 10B.

For the binder resin in toner particles, a copolymer and a graft copolymer of vinyl monomer A having the following formula (I) and vinyl monomer B selected from the group consisting of a vinyl monomer having formula (II), vinylpyridine, vinylpyrrolidone, ethylene glycol dimethacrylate, styrene, divinylbenzene and vinyltoluene can be employed.

[Vinyl monomer A]

-continued

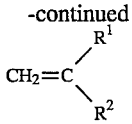

(I)

wherein $R^1$ represents hydrogen or a methyl group; and $R^2$ represents —$COOC_nH_{2n+1}$, in which n is an integer of 6 to 20.

[Vinyl monomer, one of vinyl monomer B]

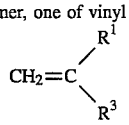

(II)

wherein $R^1$ represents hydrogen or a methyl group; and $R^3$ represents —$COOC_nH_{2n+1}$, in which n is an integer of 1 to 5,

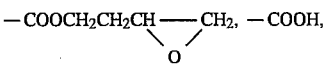

$-COOCH_2CH_2OH$, $-COOCH_2CH_2N(CH_3)_2$, or $-COOCH_2CH_2N(C_2H_5)_2$.

In addition to the above, the following binder resins can be used in the present invention.

(a) Commercially available synthetic polyethylene, polypropyrene and modified products thereof:

"N-10", "N-11", "N-12", "N-14", "N-34", "N-45", "C-10", "C-13", "C-15", "C-16", "E-10", "E-11", "E-12", "E-14" and "E-15", made by Eastman Chemical Products, Inc.;

"110P", "220P", "220MP", "320MP", "410MP", "210MP", "10MP", "405MP", "200P", "4202E" and "4053E", made by Mitsui Petrochemical Industries, Ltd.;

"131P", "151P", "161P", "171P", "E300" and "E250P", made by Sanyo Chemical Industries, Ltd.;

"H1", "H2", "A1", "A2z", "A3" and "A4", made by Sazol Co., Ltd.;

"OA Wax" and "A Wax", made by BASF Japan Ltd.;

"Bareco 500", "Bareco 2000", "E-730", "E-2018", "E-2020", "E-1040", "Petronaba C", "Petronaba C-36", "Petronaba C-400" and "Petronaba C-7500", made by Petrolite Co., Ltd.;

"PE580", "PE130", "PED121", "PED136", "PED153", "PED521", "PED522" and "PED534", made by Hoechst Japan Limited.;

"DYNI", "DYNF", "DYNH", "DYNJ" and "DYNK", made by Union Carbide Japan K.K.;

"Orlizon 805", "Orlizon 705" and "Orlizon 50", made by Monsanto Co.;

"Alathon 3", "Alathon 10", "Alathon 12", "Alathon 14", "Alathon 16", "Alathon 20", "Alathon 22" and "Alathon 23", made by Du pont de Nemours, E.I. & Co.;

"AC Polyethylene 6", "AC Polyethylene 6A" and "AC Polyethylene 15", made by Allied Chemical Corp.; and "Evaflex 150", "Evaflex 210", "Evaflex 220", "Evaflex 250", "Evaflex 260", "Evaflex 310", "Evaflex 360", "Evaflex 410", "Evaflex 420", "Evaflex 450", "Evaflex 460", "Evaflex 550" and "Evaflex 560", made by Du Pont-Mitsui Polychemicals Co., Ltd.

(b) Natural waxes such as carnauba wax, montan wax, candelilla wax, sugar cane wax, ouricury wax, beeswax, Japan wax and rice bran wax.

(c) Natural resins such as ester gum and hardened rosin.

(d) Natural-resin-modified cured resins such as natural resin modified maleic acid resin, natural resin modified phenolic resin, natural resin modified polyester resin, natural resin modified pentaerythritol resin and natural resin modified epoxy resin.

The liquid developer for use in the present invention can be prepared by dispersing the above-mentioned coloring agent, binder resin and carrier liquid comprising a polydimethyl siloxane and the isoparaffin in a dispersion mixer such as a ball mill, Keddy mill, disk mill, pin mill and oscillating mill, and kneading the mixture to prepare a toner particle having a diameter of 0.1 to 4.0 μm.

In the preparation of the liquid developer according to the present invention, the coloring agent may be preferably kneaded together with the binder resin such as the previously-mentioned synthetic polyethylenes, natural resins, and natural-resin-modified cured resins prior to the dispersion in the carrier liquid.

The liquid developers comprising a carrier liquid which comprises the polydimethyl siloxane and the isoparaffin were prepared by following the procedure described below, and a copying test was carried out.

Preparation of Liquid Developers

The following components were mixed and kneaded in a three-roll mill, so that a mixture of a coloring agent and a binder resin was prepared:

| | Parts by Weight |
|---|---|
| Carbon black "Printex U" (Trademark) made by Degussa Japan Co., Ltd. | 300 |
| Natural resin modified maleic acid "Tescon MRP" (Trademark) made by Tokushima Seiyu Co., Ltd. | 200 |
| Polyethylene "171P" (Trademark) made by Sanyo Chemical Industries, Ltd. | 600 |

The following components were mixed and kneaded in a pin mill, so that a concentrated toner was prepared:

| | Parts by Weight |
|---|---|
| The above-prepared mixture of the coloring agent and binder resin | 1000 |
| Isopar H 10% dispersion of methyl methacrylate/stearyl methacrylate/hydroxyethyl methacrylate/methacrylic acid copolymer (10/80/10/10) (solid content of 33%) | 600 |
| "Isopar H"(Trademark), made by Exxon Chemical Japan Ltd. | 2400 |

100 parts by weight of the thus prepared concentrated toner was dispersed in 1000 parts by weight of the respective carrier liquids as shown in Table 5, whereby liquid developers for use in the present invention were obtained.

Each of the above-obtained liquid developers for use in the present invention was subjected to a copying test, using a commercially available wet-type copying apparatus, "CT-5085" (Trademark), made by Ricoh Company, Ltd.

In the above-mentioned wet-type copying apparatus, an image fixing unit as shown in FIG. 3 was mounted, with a line velocity of a transfer sheet set at 228 mm/sec, an electric power of a heater 52 which was built in a heat-application roller 51 at 700 W, and a surface temperature of the heat-application roller 51 at 210±10° C.

Using the above wet-type copying apparatus, copies were continuously made for 15 minutes by allowing a transfer sheet of A-4 size having an image area ratio of 7% to pass sidewise at a copying rate of 35 copies per minute. This copying test was carried out in a room of 30 $m^3$, lined with stainless steel and not ventilated.

In the copying operation, the following items were evaluated:

(1) Sharpness of obtained images

5: clear images without character deformation

4: character images with slight deformation

3: character images with deformation to such a degree that it has no effect on the practical use.

2: unclear images with character deformation

1: illegible

-: no image formation (2) Unpleasant odor after continuous copying operation over a period of 15 minutes 5: no odor 4: faint odor 3: distinct odor 2: strong odor 1: extremely strong odor (3) Image density of obtained images—measured by Macbeth densitometer.

(4) Bubbling

The inclination to bubbling after 30 seconds was measured in accordance with JIS K 3362. 3.15.

○: 0 mι

Ⓐ: 10 mι or less

Δ: 30 mι or less x: 50 mι or less xx: 100 mι or more

The results are given in Table 5.

TABLE 5

| Type of Carrier Liquids* | Sharpness | Image Density | Bubbling | Squeezing Performance of Reverse Squeeze Roller |
|---|---|---|---|---|
| No. 1 | 5 | 1.48 | Δ | good |
| No. 2 | 5 | 1.53 | Ⓐ | good |
| No. 3 | 3.5 | 1.22 | Δ | good |
| No. 4 | 4 | 1.38 | Ⓐ | good |

Note: The copying test was carried out with the temperature of the liquid developer maintained at 25 ± 1° C.

*Type of Carrier Liquids No. 1: polydimethyl siloxane (0.65 cs)/Isopar H (75/25 vol. %) No. 2: polydimethyl siloxane (0.65 cs)/Isopar H (50/50 vol. %) No. 3: polydimethyl siloxane (1 cs)/Isopar H (75/25 vol. %) No. 4: polydimethyl siloxane (1 cs)/Isopar H (50/50 vol. %)

As can be seen from the results in Table 5, the liquid developers for use in the present invention do not generate an unpleasant odor while the carrier liquid evaporates at the image fixing step. In addition, excellent images were obtained. This is because the carrier liquid of the developer comprises the polydimethyl siloxane and the isoparaffin.

As previously mentioned, the concentrated developer container 42 which contains a concentrated liquid developer and the diluent container 43 which contains a diluent for diluting the concentrated liquid developer are provided on the liquid developer reservoir 41, as shown in FIG. 2. When the concentration of the toner in the liquid developer decreases in the liquid developer reservoir 41, the solenoid 44 is actuated to open the outlet of the concentrated developer container 42, so that the concentrated liquid developer is supplied to the liquid developer reservoir 41.

Conventionally, the petroleum aliphatic hydrocarbon is used alone as the carrier liquid for the concentrated liquid developer. For example, when the copying operation ceases for a week, the carrier liquid readily evaporates and toner particles are left alone in the concentrated liquid developer container 42. As a result, the nozzle of the concentrated liquid developer container 42 is choked with the toner particles and the concentrated liquid developer cannot be sufficiently supplied to the liquid developer reservoir 41 when the operation is resumed. Thus, the toner concentration is gradually decreased, so that the image quality of the obtained images deteriorates.

To solve the above-mentioned problem, the carrier liquid for the concentrated liquid developer comprises the silicone oil in the present invention.

Examples of the silicone oil for use in the concentrated liquid developer include a phenylmethyl silicone oil, a cyclic dimethyl polysiloxane and a dimethyl polysiloxane. It is preferable that the above-mentioned silicone oil be contained in the carrier liquid for the concentrated liquid developer in an amount ratio of 50 vol.% or more.

As the commercially available phenylmethyl silicone oil for use in the concentrated liquid developer, "SH510", "SH550" and "SH710", made by Toray Silicone Co., Ltd.; and "KF56" and "KF58", made by Shin-Etsu Polymer Co., Ltd., can be used.

As the cyclic dimethyl polysiloxane, the silicone oil having the following formula can be used:

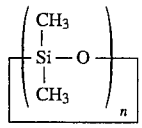

wherein n is 4 or 5.

As the dimethyl polysiloxane, hexamethyl disiloxane, commercially available under the name of "LS-7130" from Shin-Etsu Polymer Co., Ltd.; and octamethyl trisiloxane, commercially available under the name of "LS-8160" from Shin-Etsu Polymer Co., Ltd., can be used.

The above-mentioned silicone oils can be used together with the conventional petroleum aliphatic hydrocarbons which are previously mentioned. In addition, conventional toner particles comprising the coloring agent and the binder resin, which are also previously mentioned, can be used for the concentrated liquid developer.

Examples for preparation of the concentrated liquid developer for use in the present invention will now be described.

Preparation of Concentrated Liquid Developer No. 1

The following components were placed in a small-size pot and the mixture was dispersed for 40 hours:

| | Amount |
|---|---|
| Wax ["Sanwax 161-P" (Trademark), | 5 g |

-continued

| | Amount |
|---|---|
| made by Sanyo Chemical Industries, Ltd.] | |
| Binder [2EHMA-LMA-MAA (40:40:20)] | 35 g |
| Carbon black ["Raben 1035" (Trademark), made by Columbia Carbon Ltd.] | 12 g |
| Additive dye [Alkali blue] | 2 g |
| Methylphenyl siloxane ["KF-58" (Trademark), made by Shin-Etsu Polymer Co., Ltd.] | 100 g |

To the above dispersed mixture, 350 g of the methylphenyl siloxane, "KF-58" (Trademark), made by Shin-Etsu Polymer Co., Ltd., was further added, and the mixture was further dispersed for 3 hours. Thus, concentrated liquid developer No. 1 for use in the present invention was prepared.

Preparation of Concentrated Liquid Developer No. 2

The procedure for preparation of the concentrated liquid developer No. 1 was repeated except that the methylphenyl siloxane used in the above was replaced by a cyclic dimethyl siloxane having the following formula, whereby concentrated liquid developer No. 2 was prepared.

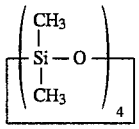

Preparation of Concentrated Liquid Developer No. 3

The procedure for preparation of the concentrated liquid developer No. 1 was repeated except that the methylphenyl siloxane used in the above was replaced by a cyclic dimethyl siloxane having the following formula, whereby concentrated liquid developer No. 3 was prepared.

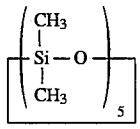

Preparation of Concentrated Liquid Developer No. 4

The procedure for preparation of the concentrated liquid developer No. 1 was repeated except that the methylphenyl siloxane used in the above was replaced by a dimethyl siloxane, whereby concentrated liquid developer No. 4 was prepared.

Since the concentrated liquid developer stored in the concentrated developer container in the wet-type image formation apparatus according to the present invention comprises a carrier liquid comprising the above-mentioned silicone oil, the evaporation of the carrier liquid is relatively slow and the nozzle of the concentrated developer container is not choked with the toner particles. Accordingly, the toner concentration in the liquid developer reservoir is constantly controlled by supplying the concentrated liquid developer thereto. This has no adverse influence on the obtained images.

What is claimed is:

1. A wet-type image formation apparatus comprising:

a latent electrostatic image formation means capable of forming on a latent-electrostatic-image-bearable photoconductive member a latent electrostatic image corresponding to an original image; and a wet-type development means capable of developing said latent electrostatic image into a visible toner image with a liquid developer which comprises (i) a carrier liquid comprising a petroleum aliphatic hydrocarbon and a silicone oil with a siloxane structure, said silicone oil being contained in said carrier liquid in an amount in a range of 50 vol.% to less than 100 vol.% of the entire volume of said carrier liquid, and (ii) toner particles comprising a coloring agent and a binder resin, which are dispersed in said carrier liquid, wherein said wet-type development means comprises (a) a liquid developer reservoir holding a quantity of said liquid developer, (b) a development roller means which supplies said liquid developer to a development section of said photoconductive member, and (c) a liquid developer supply means for supplying said liquid developer to said development roller means.

2. The wet-type image formation apparatus as claimed in claim 1, further comprising a liquid developer recovery means for recovering an excess of said liquid developer from said development roller means and returning the same to said liquid developer reservoir.

3. The wet-type image formation apparatus as claimed in claim 1, further comprising a circulation means capable of circulating said liquid developer between said development section of said photoconductive member and said liquid developer reservoir.

4. The wet-type image formation apparatus as claimed in claim 1, further comprising an image-transfer means capable of transferring said visible toner image from said photoconductive member to a transfer sheet.

5. The wet-type image formation apparatus as claimed in claim 4, further comprising a cleaning means for removing and recovering said liquid developer remaining on said photoconductive member after said visible toner image has been transferred to said transfer sheet.

6. The wet-type image formation apparatus as claimed in claim 5, further comprising a circulation means capable of circulating said liquid developer between said cleaning means and said liquid developer reservoir.

7. The wet-type image formation apparatus as claimed in claim 1, wherein said liquid developer reservoir further comprises a toner replenishment means which holds a concentrated liquid developer consisting essentially of said silicone oil and said toner particles which are dispersed in said silicone oil, with a higher toner mixing ratio than that of said liquid developer, and replenishes said concentrated liquid developer to said developer to maintain the concentration of said toner particles at a predetermined concentration.

8. The wet-type image formation apparatus as claimed in claim 1, wherein said silicone oil with said siloxane structure in said liquid developer has a boiling point of 230° C. or less.

9. The wet-type image formation apparatus as claimed in claim 1, wherein said silicone oil has a dimethyl siloxane structure.

10. The wet-type image formation apparatus as claimed in claim 9, wherein said silicone oil with said dimethyl siloxane structure has a boiling point of 230° C. or less.

11. The wet-type image formation apparatus as claimed in claim 9, wherein said silicone oil with said dimethyl siloxane structure has a viscosity of 2.5 cs or less.

12. The wet-type image formation apparatus as claimed in claim 9, wherein said silicone oil with said dimethyl siloxane structure has a molecular weight of 385 or less.

13. The wet-type image formation apparatus as claimed in claim 10, wherein said silicone oil with said dimethyl siloxane structure is contained in said carrier liquid in an amount ratio of 50 vol.% or more to less than 100 vol.%.

14. The wet-type image formation apparatus as claimed in claim 11, wherein said silicone oil with said dimethyl siloxane structure is contained in said carrier liquid in an amount ratio of 50 vol.% or more to less than 100 vol.%.

15. The wet-type image formation apparatus as claimed in claim 12, wherein said silicone oil with said dimethyl siloxane structure is contained in said carrier liquid in an amount ratio of 50 vol.% or more to less than 100 vol.%.

16. The wet-type image formation apparatus as claimed in claim 1, wherein said silicone oil has a cyclic siloxane structure.

17. The wet-type image formation apparatus as claimed in claim 16, wherein said silicone oil with said cyclic siloxane structure has a viscosity of 4.0 or less.

18. The wet-type image formation apparatus as claimed in claim 16, wherein said silicone oil with said cyclic siloxane structure is a trimer, a tetramer or a pentamer.

19. The wet-type image formation apparatus as claimed in claim 17, wherein said silicone oil with said cyclic siloxane structure is contained in said carrier liquid in an amount ratio of 50 vol.% or more to less than 100 vol.%.

20. The wet-type image formation apparatus as claimed in claim 18, wherein said silicone oil with said cyclic siloxane structure is contained in said carrier liquid in an amount ratio of 50 vol.% or more to less than 100 vol.%.

21. The wet-type image formation apparatus as claimed in claim 1, wherein said silicone oil with said siloxane structure is polydimethyl siloxane and said petroleum aliphatic hydrocarbon is isoparaffin.

22. The wet-type image formation apparatus as claimed in claim 21, wherein said polydimethyl siloxane is contained in said carrier liquid in an amount ratio of 50 vol.% or more to less than 100 vol.%.

* * * * *